US010890194B2

(12) United States Patent
Tadokoro et al.

(10) Patent No.: US 10,890,194 B2
(45) Date of Patent: Jan. 12, 2021

(54) AIR-SENDING DEVICE AND AIR-CONDITIONING APPARATUS USING THE SAME

(71) Applicant: Mitsubishi Electric Corporation, Chiyoda-ku (JP)

(72) Inventors: Takahide Tadokoro, Chiyoda-ku (JP); Seiji Nakashima, Chiyoda-ku (JP); Yutaka Aoyama, Chiyoda-ku (JP); Shuhei Mizutani, Chiyoda-ku (JP); Naomichi Tamura, Chiyoda-ku (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 78 days.

(21) Appl. No.: 16/072,977

(22) PCT Filed: Feb. 24, 2016

(86) PCT No.: PCT/JP2016/055347

§ 371 (c)(1),
(2) Date: Jul. 26, 2018

(87) PCT Pub. No.: WO2017/145275

PCT Pub. Date: Aug. 31, 2017

(65) Prior Publication Data

US 2019/0040873 A1 Feb. 7, 2019

(51) Int. Cl.

| | |
|---|---|
| ***F04D 29/38*** | (2006.01) |
| ***F04D 29/54*** | (2006.01) |
| ***F04D 29/66*** | (2006.01) |
| *F04D 29/70* | (2006.01) |
| *F25D 17/06* | (2006.01) |

(52) U.S. Cl.

CPC ..... *F04D 29/384* (2013.01); *F04D 29/386* (2013.01); *F04D 29/388* (2013.01);
(Continued)

(58) Field of Classification Search

CPC .... F04D 29/384; F04D 29/386; F04D 29/388; F04D 29/545; F04D 29/663;
(Continued)

(56) References Cited

U.S. PATENT DOCUMENTS 3,751,181 A * 8/1973 Hayashi ..... F04D 29/382 416/132 R
4,173,995 A * 11/1979 Beck ..... B60K 11/02 123/41.49

(Continued)

FOREIGN PATENT DOCUMENTS

JP 2003-130396 A 5/2003
JP 2007-303432 A 11/2007

(Continued)

OTHER PUBLICATIONS

International Search Report dated May 24, 2016 in PCT/JP2016/055347 filed Feb. 24, 2016.

*Primary Examiner* — Moshe Wilensky
*Assistant Examiner* — Joshua R Beebe
(74) *Attorney, Agent, or Firm* — Xsensus LLP

(57) ABSTRACT

Provided is an air-sending device in which, in blades, an upstream end of a blade outer periphery is more on an upstream side than an upstream end of a blade inner periphery as seen along a rotation axis, and a downstream end of a blade outer periphery is more on a downstream side than a downstream end of the blade inner periphery, and in which, in the blades, when an angle formed by a line segment, which connects a point internally dividing a line segment connecting the downstream end and the upstream end of an outer periphery of the blades along the rotation axis and a point internally dividing a line segment connecting the downstream end and the upstream end of an inner periphery of the blades along the rotation axis at the same ratio to each other, and a reference line is defined as θ, and a direction
(Continued)

inclined toward the downstream side is defined as positive, the angle θ is changed from negative to positive at a duct portion.

12 Claims, 12 Drawing Sheets

(52) U.S. Cl.
CPC ..... *F04D 29/545* (2013.01); *F04D 29/663* (2013.01); *F04D 29/667* (2013.01); *F04D 29/703* (2013.01); *F05B 2240/301* (2013.01); *F25D 17/067* (2013.01)

(58) Field of Classification Search
CPC ..... F04D 29/667; F04D 29/703; F04D 29/38; F05B 2240/301; F25D 17/067
See application file for complete search history.

(56) References Cited

U.S. PATENT DOCUMENTS 4,189,281 A * 2/1980 Katagiri ..... F04D 29/547 123/41.49
4,329,946 A * 5/1982 Longhouse ..... F01P 5/06 123/41.49
4,671,739 A * 6/1987 Read ..... F04D 29/325 416/134 R
4,768,472 A * 9/1988 Hayashi ..... F01P 5/06 123/41.49
5,466,120 A * 11/1995 Takeuchi ..... F04D 29/703 415/119
6,450,760 B1 * 9/2002 Furukawa ..... F04D 29/384 415/119
6,454,527 B2 * 9/2002 Nishiyama ..... F01P 11/12 264/51
2010/0068028 A1 * 3/2010 Bushnell ..... F04D 29/164 415/1
2014/0026833 A1 * 1/2014 Jensen ..... F01P 5/06 123/41.49
2015/0176597 A1 * 6/2015 Tadokoro ..... F04D 29/667 416/243

FOREIGN PATENT DOCUMENTS

JP 2011-185236 A 9/2011
JP 2013-144951 A 7/2013
JP 2015-81691 A 4/2015
WO WO-2014024654 A1 * 2/2014 ..... F04D 29/384

* cited by examiner

AIR-SENDING DEVICE AND AIR-CONDITIONING APPARATUS USING THE SAME

TECHNICAL FIELD

The present invention relates to an air-sending device including a propeller fan, and to an air-conditioning apparatus using the same.

BACKGROUND ART

Hitherto, there have been proposed various types of air-sending devices devised to achieve reduction in noise. For example, as disclosed in Patent Literature 1, there is proposed an air-sending device in which, as means for reducing consumption of power for drive of a fan and reducing noise at the time of sending air, an S-shaped expanded portion is formed on an upstream side of a bellmouth to suppress turbulence in a suction flow. Moreover, in an outdoor unit of an air-conditioning apparatus, typically, heat exchange between outdoor air and refrigerant is performed by allowing an air stream generated by rotation of a fan to pass through a heat exchanger. In Patent Literature 2, there is proposed means for enhancing efficiency of an air-sending device by expanding a downstream portion of a bellmouth in a radial direction. Further, as disclosed in Patent Literature 3, there is also proposed an outdoor unit of an air-conditioning apparatus in which a cover for preventing rotating blades from being touched by hand is mounted on an air outlet side.

CITATION LIST

Patent Literature

Patent Literature 1: Japanese Unexamined Patent Application Publication No. 2011-185236

Patent Literature 2: Japanese Unexamined Patent Application Publication No. 2015-81691

Patent Literature 3: Japanese Unexamined Patent Application Publication No. 2003-130396

SUMMARY OF INVENTION

Technical Problem

In the case of backward-swept blades disclosed in Patent Literature 1, a normal direction of each blade surface is oriented radially inward in a region from an intermediate portion of a blade chord to a trailing edge of the blade chord. Thus, suction from a lateral side of the blades is strong. The bellmouth surrounding the blades includes a duct portion and an entry portion. The duct portion has a minimum inner diameter. At the entry portion, a distance between the bellmouth and a blade outer peripheral end is large. A region involving strong suction from the lateral side extends over two regions of the bellmouth. As a result, a difference in speed of suction from the lateral side occurs, and a vortex which causes turbulence is generated in a region in which the inner diameter is minimum. Consequently, noise may occur.

In the air-conditioning apparatus disclosed in Patent Literature 2, a position of a downstream end on a blade inner periphery and a position of a downstream end on a blade outer periphery are at substantially the same height in a rotation axis direction. Therefore, the normal direction of the blade surface is oriented substantially in the axis direction on the air outlet side. The air stream which flows through the blades is oriented radially outward by a centrifugal force. Thus, the blowing air stream is deflected radially outward. As a result, the air velocity is locally increased, and noise is increased.

In the outdoor unit of the air-conditioning apparatus disclosed in Patent Literature 3, the cover is mounted to the air outlet side so as to prevent the rotating blades from being touched by hand. For the cover having the blowing direction oriented vertically upward, in order to increase strength with respect to an object falling from an outside or prevent accumulation of falling snow in the bellmouth, it is required that a mesh be finer or that bars forming a guard each be increased in thickness. An air stream blowing from the fan is deflected outward by a centrifugal force, and an airflow resistance of the air stream passing through the mesh is increased, with the result that loss is increased.

The present invention has been made to solve the problems described above, and has an object to provide an air-sending device and an air-conditioning apparatus using the same, which are capable of achieving reduction in noise and improvement in efficiency as well as increase in airflow rate by reducing loss of inflow from a lateral side of a fan and suppressing loss of an air stream passing through a guard of a bellmouth.

Solution to Problem

According to one embodiment of the present invention, there is provided an air-sending device, including: a propeller fan including a boss mounted to a rotation axis and a plurality of blades mounted on a periphery of the boss; and a bellmouth surrounding an outer peripheral edge of the propeller fan, wherein the bellmouth includes: a duct portion having a cylindrical shape and surrounding the outer peripheral edge of the propeller fan; and an entry portion, which is formed on upstream of the duct portion, and is reduced in air passage area from upstream toward downstream, wherein, in the blades, an upstream end of a blade outer periphery is more on an upstream side than an upstream end of a blade inner periphery, and a downstream end of the blade outer periphery is more on a downstream side than a downstream end of the blade inner periphery, as seen along the rotation axis, and wherein, in the blades, when an angle formed by a line segment, which connects a point internally dividing a line segment connecting the downstream end and the upstream end of an outer periphery of the blades along the rotation axis and a point internally dividing a line segment connecting the downstream end and the upstream end of an inner periphery of the blades along the rotation axis at the same ratio to each other, and a reference line being a straight line perpendicular to the rotation axis is defined as $\theta$, and a direction inclined toward the downstream side is defined as positive, the angle $\theta$ is changed from negative to positive at a duct portion.

Advantageous Effects of Invention

With the air-sending device according to one embodiment of the present invention, the air stream is oriented inward, and hence it is possible to achieve the reduction in noise and the improvement in efficiency as well as the increase in airflow rate by reducing the loss of the inflow from the lateral side of the fan and suppressing the loss of the air stream passing through the guard of the bellmouth.

DESCRIPTION OF EMBODIMENTS

Figure 1:
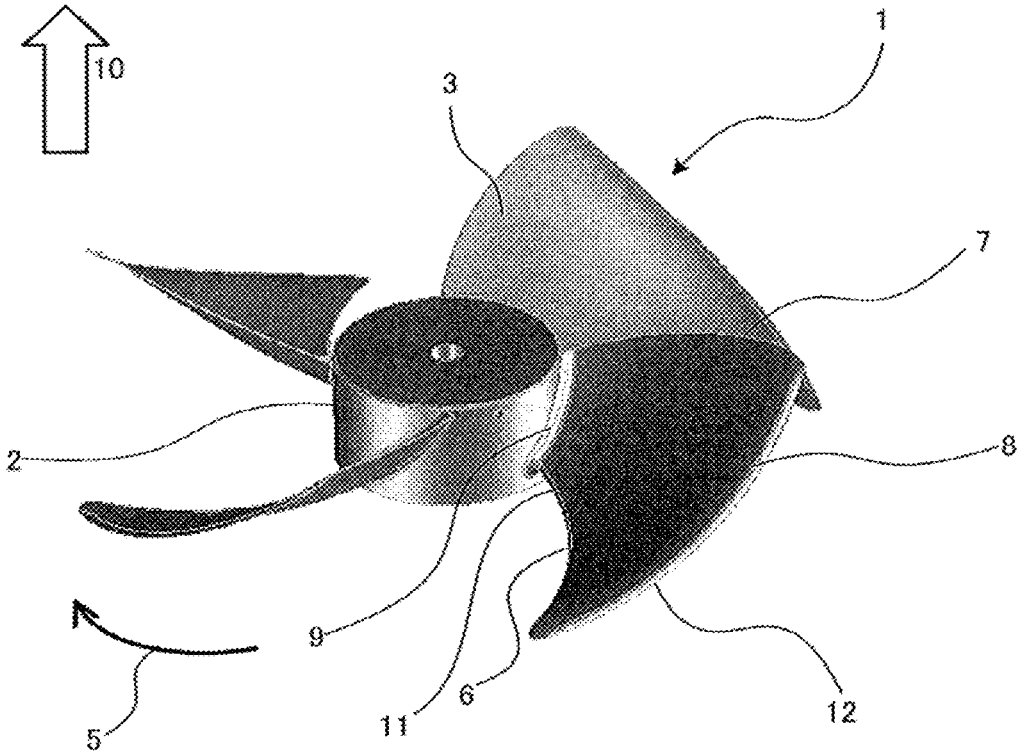
FIG. 1 is a perspective view for illustrating an example of a configuration of a propeller fan to be used for an air-sending device according to Embodiment 1 of the present invention.

Now, referring to the drawings as appropriate, a description is given of embodiments of the present invention. In the drawings including FIG. 1 referred to below, a relationship of sizes of components may be different from that of an actual product. Moreover, in the drawings including FIG. 1 referred to below, components which are denoted by the same reference symbols are the same or corresponding components, and this applies to the entire description. Further, modes of components in the entire description are mere examples, and are not limited to those given in the description.

Embodiment 1

FIG. 1 is a perspective view for illustrating an example of a configuration of a propeller fan 1 to be used for an air-sending device according to Embodiment 1 of the present invention. With reference to FIG. 1, description is made of the propeller fan 1. In FIG. 1, a rotation direction of the propeller fan 1 is indicated by the rotation direction 5, and an air stream direction is indicated by the air stream direction 10.

As illustrated in FIG. 1, the propeller fan 1 includes a cylindrical boss 2 and a plurality of blades 3. The boss 2 is provided at a center of the propeller fan 1. The blades 3 are mounted to a periphery of the boss 2. The boss 2 is connected to a shaft (rotation axis 13) of a drive device such as a motor (not shown). Moreover, in FIG. 1, illustration is given of a state in which four blades 3 are mounted to the boss 2, as an example.

The blades 3 each are defined so as to be surrounded by a leading edge 6 oriented in the rotation direction 5, a trailing edge 7 opposed to the leading edge 6, an end portion on a blade outer periphery side (outer peripheral end 8), and an inner peripheral end 9 connected to the boss 2 at an end portion of the blade 3 on an inner periphery side. A side of a blade surface facing a downstream side in the air stream direction 10 is referred to as a pressure surface 11, and a side of the blade surface facing an upstream side in the air stream direction 10 is referred to as a suction surface 12.

Figure 2:
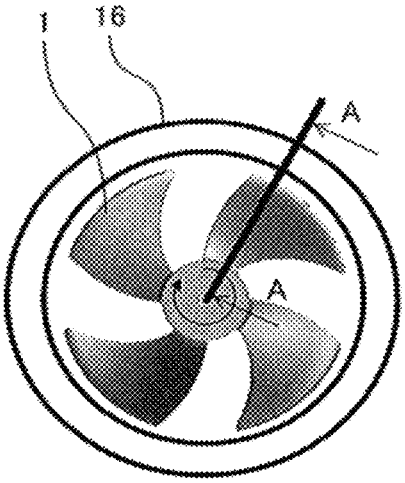
FIG. 2 is a top view of the propeller fan to be used for the air-sending device according to Embodiment 1 of the present invention.
Figure 3:
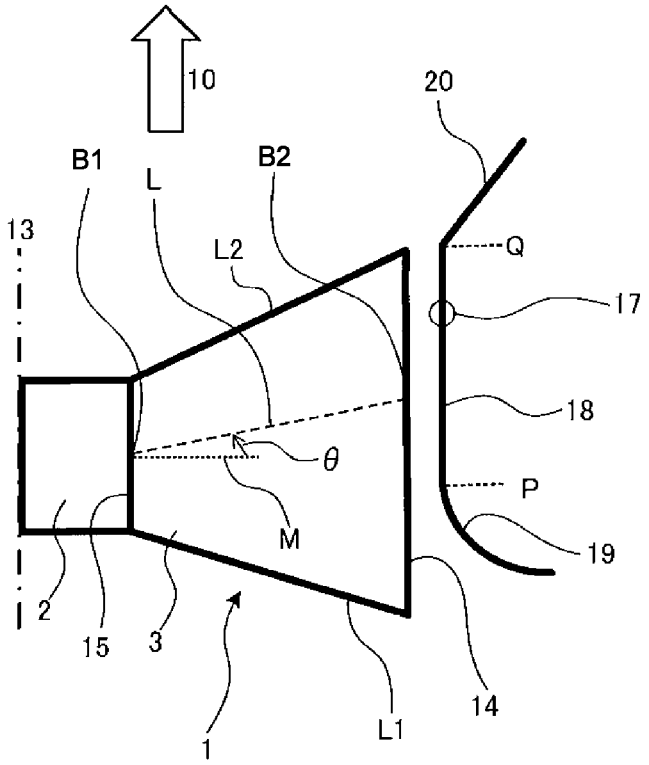
FIG. 3 is a sectional view of FIG. 2, and is an illustration of a cross section including a rotation axis taken along a radial direction (A-A cross section).

FIG. 2 is a top view of the propeller fan 1. FIG. 3 is a sectional view of FIG. 2, and is an illustration of a cross section including the rotation axis 13 taken along a radial direction (A-A cross section). FIG. 3 is an illustration of a locus of the blades 3 which appears on the A-A cross section when the propeller fan 1 is rotated (revolved projection). With reference to FIG. 2 and FIG. 3, description is made of the propeller fan 1 more in detail. In the following description, a locus formed by the outer peripheral end 8 of the propeller fan 1 on the cross section is referred to as an outer peripheral edge 14, and a locus formed by the inner peripheral end 9 on the cross section is referred to as an inner peripheral edge 15.

As illustrated in FIG. 2 and FIG. 3, on an outer side of the outer peripheral edge 14 of the propeller fan 1, a bellmouth 16 surrounding the blades 3 is provided. The bellmouth 16 is formed of three portions including a duct portion 18, an exit portion 20, and an entry portion 19.

The locus of the outer peripheral edge 14 formed by rotation of the blades 3 roughly has a columnar shape. The duct portion 18 is a cylindrical portion which is arranged close to the cylindrical locus to surround the locus.

The entry portion 19 is a portion which is formed on an upstream side of the duct portion 18 and is reduced in air passage area from upstream toward downstream. In FIG. 2, illustration is given of a state in which the sectional shape is formed of a curved surface, as an example. However, there may be partially formed a portion at which the air passage area is linearly reduced. Moreover, even a configuration in which the air passage area is not continuously reduced in midway also does not affect the phenomenon described in the embodiment.

The exit portion 20 is a portion which is formed on a downstream side of the duct portion 18 and is increased in air passage area toward downstream. In FIG. 2, illustration is given of a state in which the exit portion 20 has a tapered sectional shape which expands linearly, as an example. However, the exit portion 20 may have a smooth curved surface similarly to the entry portion 19. Moreover, even a configuration in which the air passage area is not continuously increased in midway also does not affect the phenomenon described in this embodiment.

The duct portion 18 has a function of securing a difference in pressure increased by the blades 3 between the upstream side and the downstream side. Therefore, in order to prevent leakage of air, a size of the gap is typically set to be larger than 0% and equal to or smaller than about 3% of a fan diameter. When the duct portion 18 is manufactured by pressing of metal, the duct portion 18 is formed into a cylinder having a substantially constant inner diameter. When the duct portion 18 is manufactured with resin, a draft angle of several percent is given along a drawing direction to allow drawing of the duct portion 18 after molding, and an inner diameter varies along the rotation axis direction.

A distance between the outer peripheral edge 14 of the blades 3 and the bellmouth 16 is minimum at the duct portion 18, and a point on the bellmouth 16 which is closest to the outer peripheral edge 14 of the blades 3 is referred to as a point 17. In the cross section of the bellmouth, when a boundary between the duct portion 18 and the entry portion 19 is P, and a boundary between the duct portion 18 and the exit portion 20 is Q, the point 17 may be located at any position between the boundaries P and Q in FIG. 3.

Moreover, a line segment connecting an upstream end of the inner peripheral edge 15 of the blades 3 and an upstream end of the outer peripheral edge 14 of the blades 3 to each other is defined as L1, and a line segment connecting an upstream end of the inner peripheral edge 15 of the blades 3 and an upstream end of the outer peripheral edge 14 of the blades 3 is defined as L2. In the present invention, consideration is made of a propeller fan in which, with a straight line M perpendicular to the rotation axis 13 as a reference line, the line segment L1 is inclined toward the downstream side with respect to the reference line, and the line segment L2 is inclined toward the upstream side with respect to the reference line.

As illustrated in FIG. 3, a point internally dividing the outer peripheral edge 14 of the blades 3 into the upstream side and the downstream side is defined as B2, and a point internally dividing the inner peripheral edge 15 into the upstream side and the downstream side at the same ratio as the outer peripheral edge 14 is defined as B1. A line segment connecting the points B1 and B2 to each other is defined as L, and an angle formed by the line segment L and the straight line M perpendicular to the rotation axis 13 is defined as θ. The angle θ of inclination toward the downstream side with respect to the straight line M is positive.

Figure 4:
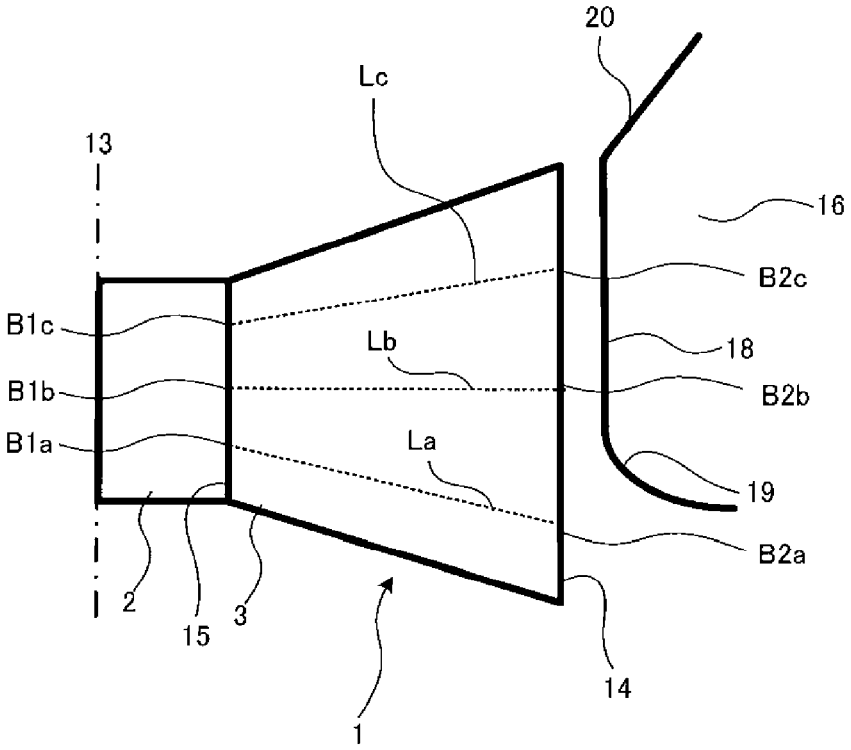
FIG. 4 is an explanatory view for illustrating a line segment L illustrated in FIG. 3.
Figure 5:
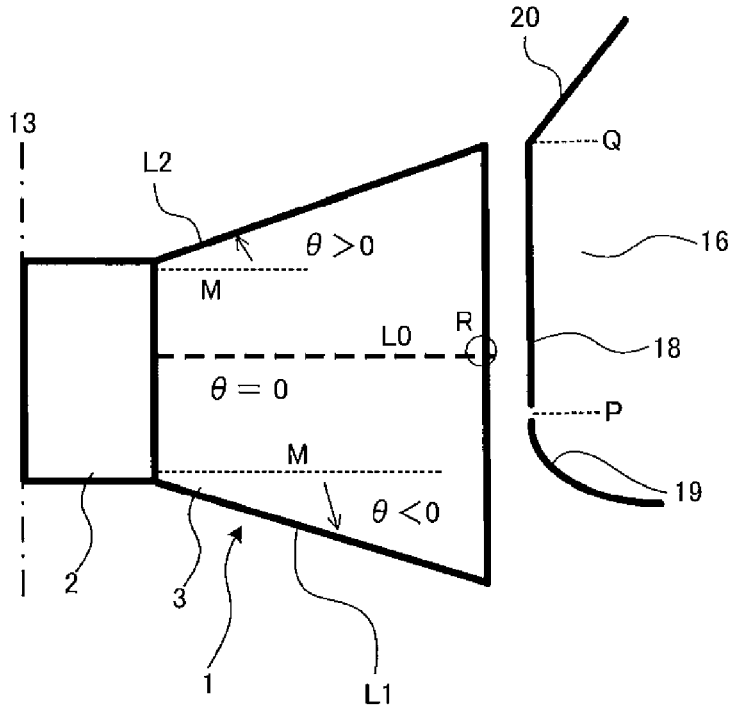
FIG. 5 is an explanatory view for illustrating the line segment L illustrated in FIG. 3.

FIG. 4 and FIG. 5 are explanatory views for illustrating the line segment L illustrated in FIG. 3. Description is made of the line segment L with reference to FIG. 4 and FIG. 5.

The line segment L can be infinitely depicted as, for example, La, Lb, or Lc by selecting a combination of the point B2 internally dividing the outer peripheral edge 14 and the point B1 internally dividing the inner peripheral edge 15 from combinations of, for example, (B1*a*, B2*a*), (B1*b*, B2*b*), and (B1*c*, B2*c*). The angle θ formed by the line segment L and the straight line M is negative on the upstream side L1 of the blade 3 and is positive on the downstream edge L2 of the blade 3, as illustrated in FIG. 5. Therefore, there exists a line segment L0 which forms an angle of 0 degrees. When an internally dividing point on the outer peripheral edge 14 which gives an angle of θ=0 degrees is defined as R, in the example of the present invention, the point R is located within a region surrounded by the duct portion 18 of the bellmouth 16. That is, the angle θ falls in the range between negative values and positive values at the duct portion 18 of the bellmouth 16.

Figure 6:
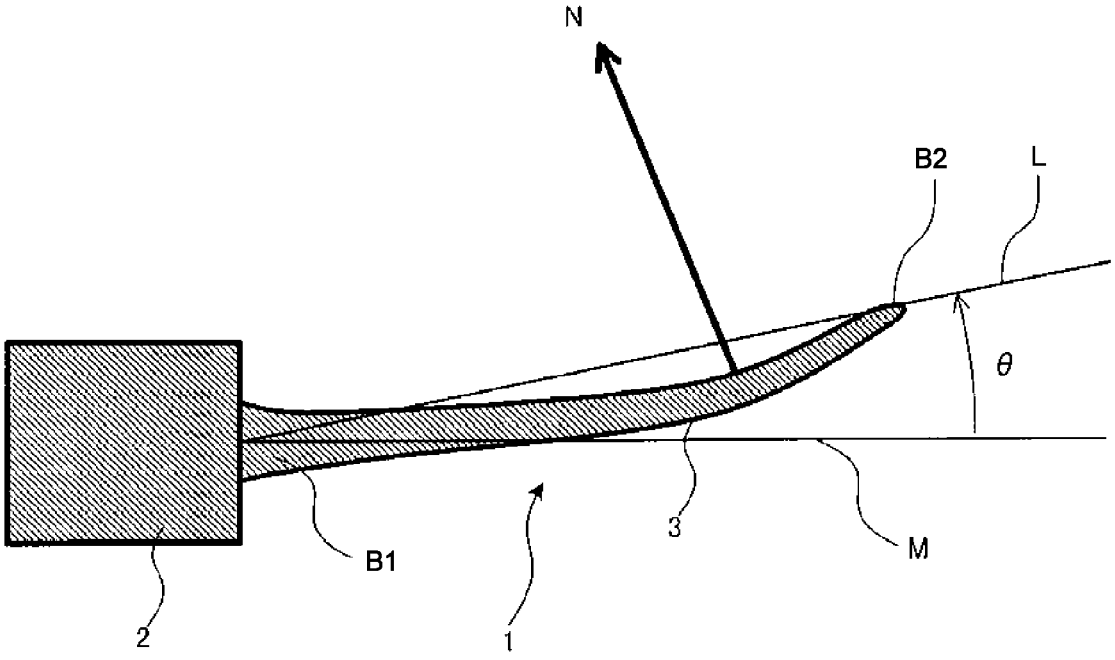
FIG. 6 is a sectional view for illustrating a blade of the propeller fan to be used for the air-sending device according to Embodiment 1 of the present invention.

FIG. 6 is a sectional view for illustrating the blade 3 of the propeller fan 1. FIG. 6 is an illustration of an example of the sectional shape of the blade in which each radius of the three-dimensional blade 3 is internally divided into the upstream side and the downstream side at the same ratio.

For example, as illustrated in FIG. 6, when the angle θ formed by the straight line L and the straight line M perpendicular to the rotation axis 13 is negative, a normal direction N of the pressure surface 11 of the blade 3 is oriented radially outward. When the angle θ is positive, the normal direction is oriented radially inward. When the angle θ is negative, the normal direction is oriented radially outward. Even though the cross section of the blade is a curved surface as illustrated in FIG. 6, description is made by an average normal direction with the line segment L connecting the inner peripheral edge 15 of the blades 3 and the outer peripheral edge 14 to each other.

Figure 7:
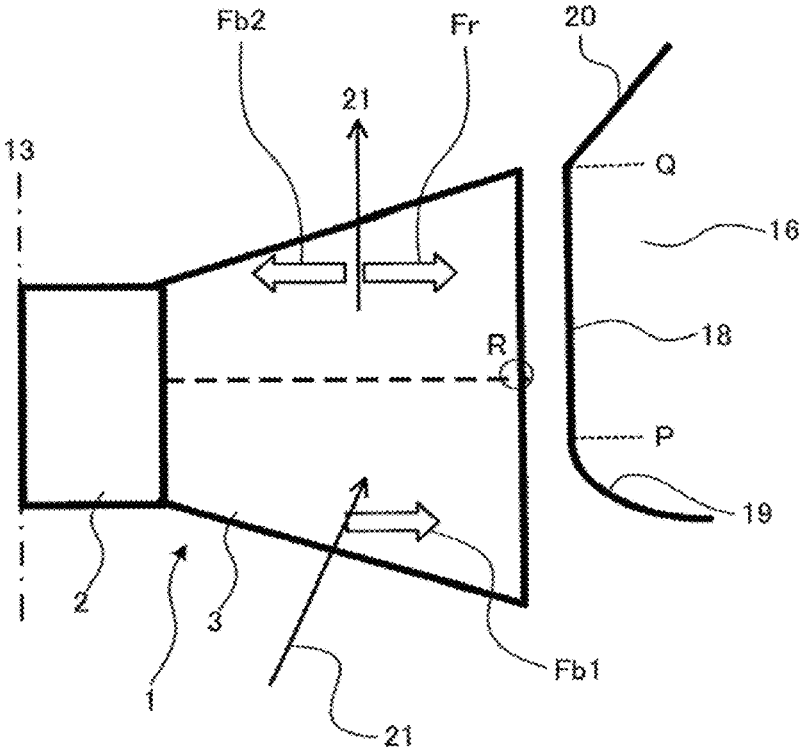
FIG. 7 is an explanatory schematic view for illustrating an operation of the air-sending device including the propeller fan to be used for the air-sending device according to Embodiment 1 of the present invention.
Figure 8:
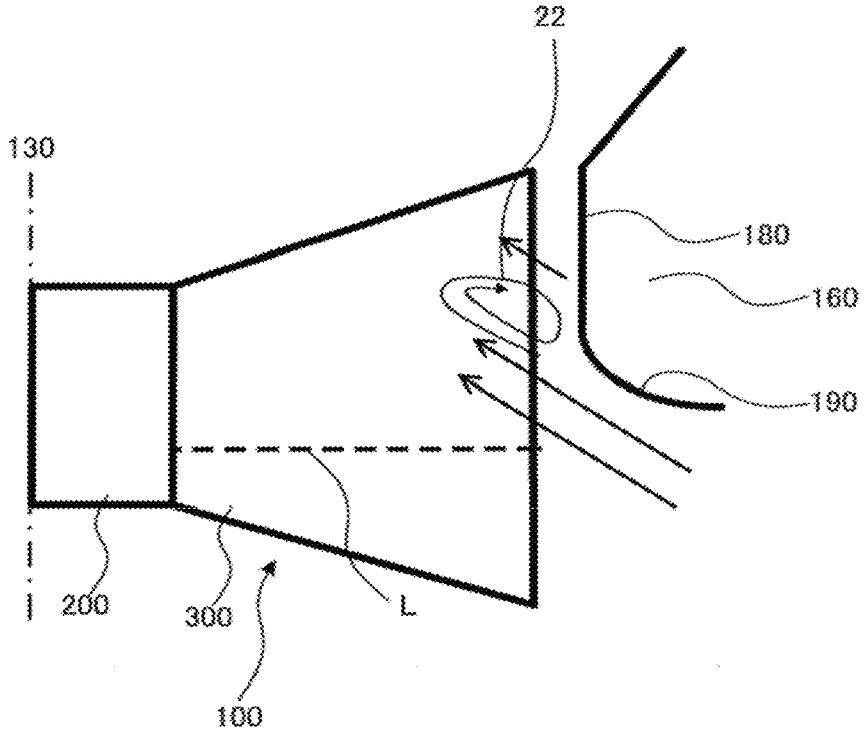
FIG. 8 is an explanatory schematic view for illustrating an operation of a related-art air-sending device.
Figure 9:
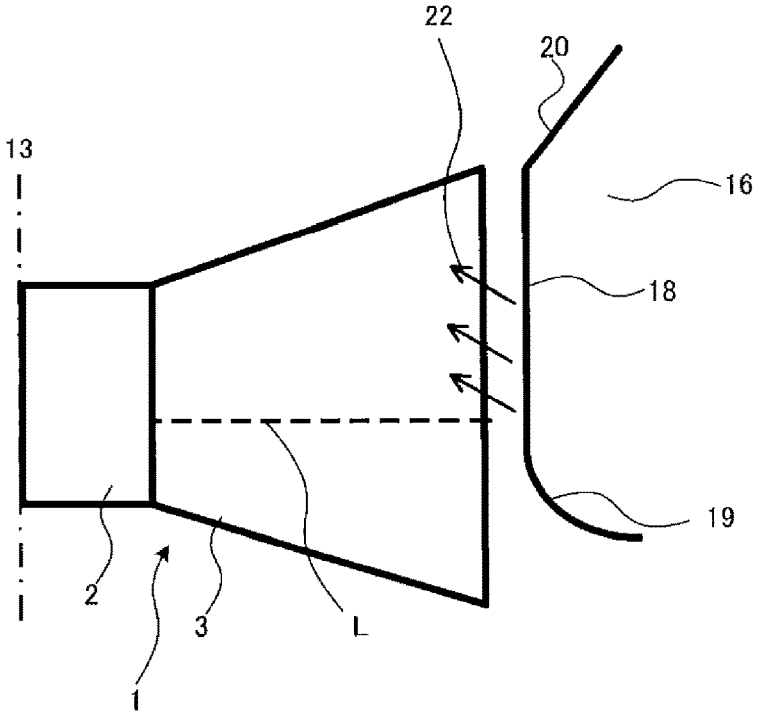
FIG. 9 is an explanatory schematic view for illustrating an operation of the air-sending device including the propeller fan to be used for the air-sending device according to Embodiment 1 of the present invention.

Now, description is made of an operation of the air-sending device according to Embodiment 1 with reference to the schematic views in FIG. 7 to FIG. 9 for illustrating an air stream. FIG. 7 is an explanatory schematic view for illustrating an operation of the air-sending device including the propeller fan 1. FIG. 8 is an explanatory schematic view for illustrating an operation of a related-art air-sending device. FIG. 9 is an explanatory schematic view for illustrating an operation of the air-sending device including the propeller fan 1.

When the propeller fan 1 is rotated by a device such as a fan motor configured to drive the propeller fan 1, the blades 3 push out the air stream toward the downstream side, and air flows in from upstream. On the upstream side of the blade on which the angle θ formed by the line segment L and the straight line M perpendicular to the rotation axis 13 is negative, the normal line of the pressure surface 11 of each blade 3 is oriented radially outward. Thus, air 21 having flowed into the blades 3 is guided radially outward by a force Fb1 applied radially outward. On the outer periphery side of the blades 3, a distance from the rotation axis 13 is large, and hence a moment of the force applied to the air stream is large. Thus, a force for driving the blades 3 is efficiently applied to the air. Therefore, power consumption of the propeller fan 1 is reduced, and the rotation number given at the time of sending air at a required airflow rate is reduced, thereby being capable of reducing noise.

In the region in which the angle θ has a positive value on the downstream side of the broken line region in which the angle θ is 0 degrees, the normal line of the pressure surface 11 of each blade 3 is oriented radially inward. The air flowing through the blades is increased in revolving speed from upstream toward downstream, and a force directed radially outward is applied by the centrifugal force Fr. However, a force Fb directed radially inward is applied from the pressure surface 11, and hence balance between the centrifugal force Fr and the force Fb causes the air stream to be less liable to deflect toward the radially outer side as compared to the related art. When the air stream is even, the air velocity decreases. The loss is proportional to a logarithmic value of the second power of the air velocity, and the noise is proportional to a logarithmic value of the sixth power of the air velocity. Thus, the energy loss and the noise are reduced. The air flowing through the blades is pushed out radially inward, and thus a suction stream is generated on the radially inner side at the outer peripheral edge 14.

A related-art propeller fan 100 illustrated in FIG. 8 includes a cylindrical boss 200 and a plurality of blades 300. The cylindrical boss 200 is provided at a center of the propeller fan 100. The blades 300 are mounted on a periphery of the cylindrical boss 200. The boss 200 is connected to a shaft (rotation axis 130) of a drive device such as a motor (not shown).

As illustrated in FIG. 8, according to a case example disclosed in Patent Literature 1, a region involving strong suction toward the radially inner side at the blade outer peripheral edge on downstream of the straight line L extends over the duct portion 180 and the entry portion 190 of the bellmouth 160. At the entry portion 190, the blades 300 and a wall surface of the bellmouth 160 are far apart from each other, and a suction space is large. Thus, the air velocity toward the radially inner side is high. In contrast, at the duct portion 180, a gap between the blades 300 and the wall surface of the bellmouth 160 is small. Thus, the suction air velocity is low. The difference in speed of suction at the blade outer peripheral edge is large, with the result that a vortex 22 is generated. The vortex generated at the outer peripheral edge may cause loss or turbulence, and the flow passage at an outer peripheral portion of the blades 300 is narrowed. Therefore, the efficiency of the blades 300 at the time of sending air is degraded, and the rotation number for sending air at the required airflow rate is increased, which may result in increase in noise.

Meanwhile, in the air-sending device according to Embodiment 1, as illustrated in FIG. 9, the outer peripheral edge 14 involving strong suction toward the radially inner side at the outer peripheral edge 14 on downstream of the straight line L is accommodated within the duct portion 18 of the bellmouth 16. Thus, the suction space is equalized, and the air velocity difference is reduced, thereby suppressing the vortex immediately after inflow from the outer peripheral edge 14. As a result, with the air-sending device according to Embodiment 1, the loss or turbulence of the flow is reduced, and a large flow passage at the blade outer peripheral portion can be secured, thereby being capable of operating the blades 3 with high efficiency and low noise.

Embodiment 2

Figure 10:
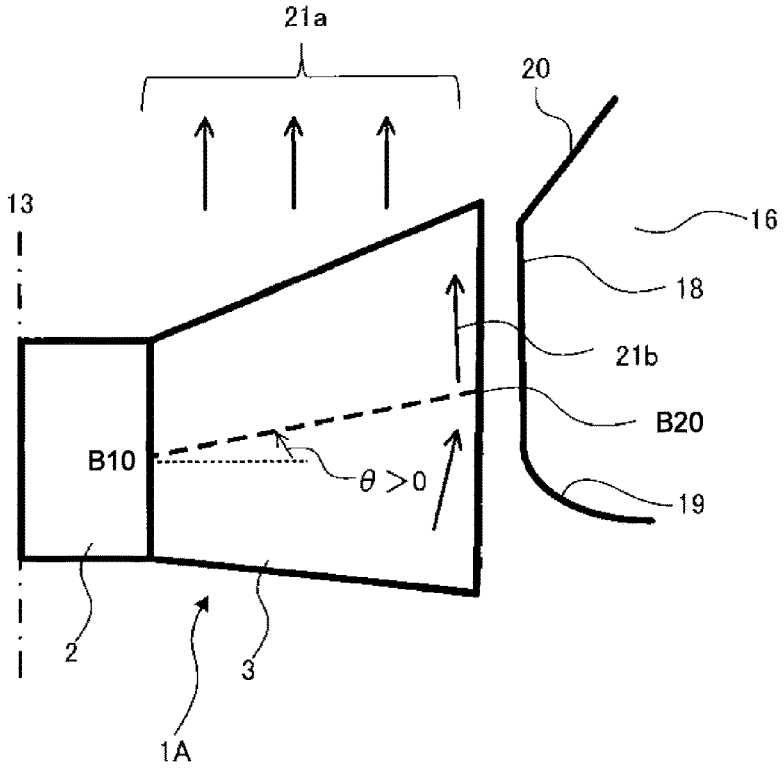
FIG. 10 is an explanatory schematic view for illustrating an operation of an air-sending device according to Embodiment 2 of the present invention.

FIG. 10 is an explanatory schematic view for illustrating an operation of an air-sending device according to Embodiment 2 of the present invention. With reference to FIG. 10, description is made of the air-sending device according to Embodiment 2. FIG. 10 is an illustration of a revolved projection on a cross section including the rotation axis 13 along the radial direction. In Embodiment 2, differences from Embodiment 1 are mainly described. Components which are the same as those of Embodiment 1 are denoted by the same reference symbols, and description thereof is omitted.

In a propeller fan 1A of the air-sending device according to Embodiment 2, an angle θ formed by a straight line L0, which connects a point B20 bisecting the outer peripheral edge 14 and a point B10 bisecting the inner peripheral edge 15 to each other, and a straight line M perpendicular to the rotation axis 13 has a positive value. The angle θ formed by the straight line L0, which connects the point bisecting the outer peripheral edge 14 of the blades 3 and the point bisecting the inner peripheral edge 15 of the blades 3 to each other, and the straight line M perpendicular to the rotation axis 13 is positive. Therefore, the region in which the normal direction of the blade 3 is oriented radially inward is large. The region in which the air stream passing through the blades receives the force directed radially inward is increased. Therefore, in the air-sending device according to Embodiment 2, an air stream 21*a* flowing from the blades 3 is equalized in the radial direction, thereby being capable of reducing the loss and noise. Moreover, in the air-sending device according to Embodiment 2, the force directed radially inward acts more strongly on an air stream 21*b* flowing through the duct portion 18. Thus, the air stream hitting against the duct portion 18 can be suppressed, and the turbulence generated in the duct portion 18 can also be suppressed, thereby being capable of achieving reduction in loss and reduction in noise.

Embodiment 3

Figure 11:
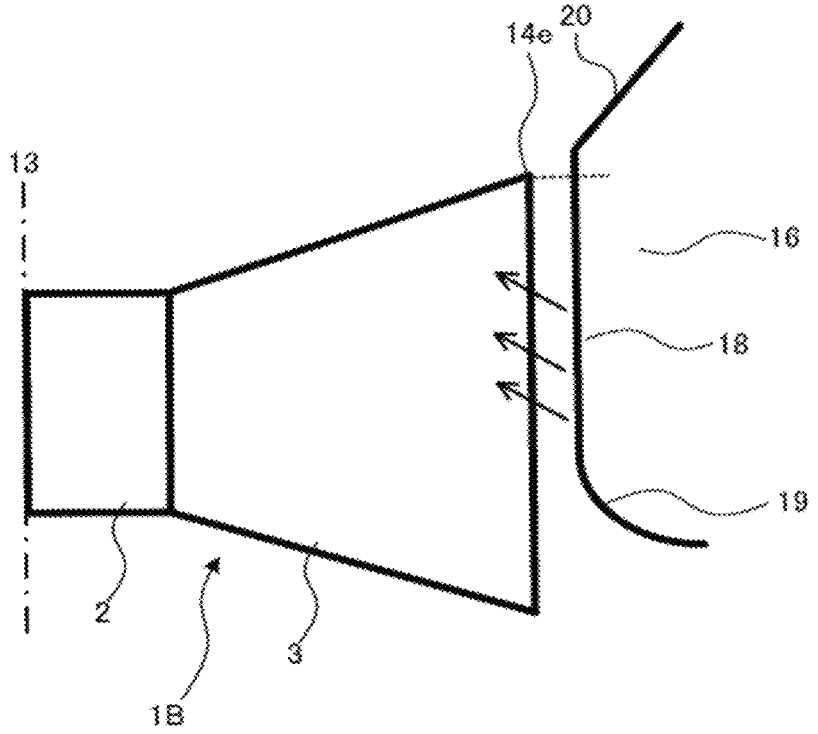
FIG. 11 is an explanatory schematic view for illustrating an operation of an air-sending device according to Embodiment 3 of the present invention.
Figure 12:
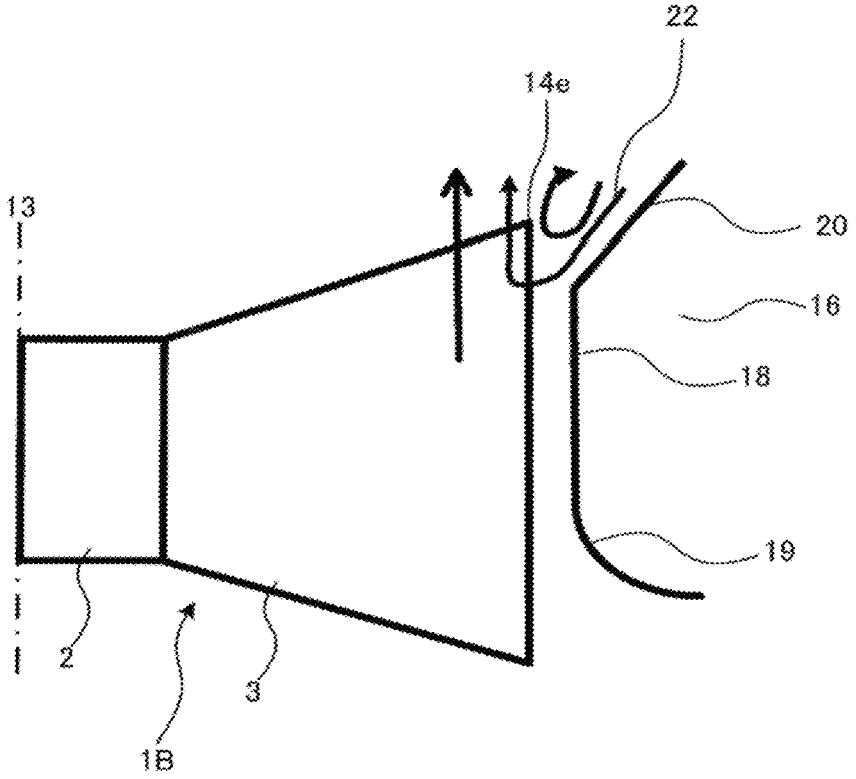
FIG. 12 is an explanatory schematic view for illustrating the operation of the air-sending device according to Embodiment 3 of the present invention.

FIG. 11 and FIG. 12 are explanatory schematic views for illustrating an operation of an air-sending device according to Embodiment 3 of the present invention. With reference to FIG. 11 and FIG. 12, description is made of the air-sending device according to Embodiment 3. FIG. 11 is an illustration of a revolved projection on a cross section including the rotation axis 13 along the radial direction. In Embodiment 3, differences from Embodiments 1 and 2 are mainly described. Components which are the same as those of Embodiments 1 and 2 are denoted by the same reference symbols, and description thereof is omitted.

In a propeller fan 1B of the air-sending device according to Embodiment 3, a downstream end 14*e* of the outer peripheral edge 14 of the blades 3 is surrounded by the duct portion 18. At this part, the air stream passing through the downstream end of the outer peripheral edge 14 of the blades 3 receives energy from the blades 3 most strongly, and the air stream velocity is high. When the downstream end 14*e* of the outer peripheral edge 14 of the blades 3 is at a position of being surrounded by the exit portion 20 as illustrated in FIG. 12, the air stream having passed through the blades 3 attracts air between the blades 3 and the exit portion 20, and the vortex 22 is generated, which may cause increase in loss or noise. In the air-sending device according to Embodiment 3, the outer peripheral edge 14 of the blades 3 is surrounded by the duct portion 18, thereby enabling reduction in generation of the vortex caused by attraction of the air stream from the lateral side. Therefore, with the air-sending device according to Embodiment 3, the loss can be reduced.

Embodiment 4

Figure 13:
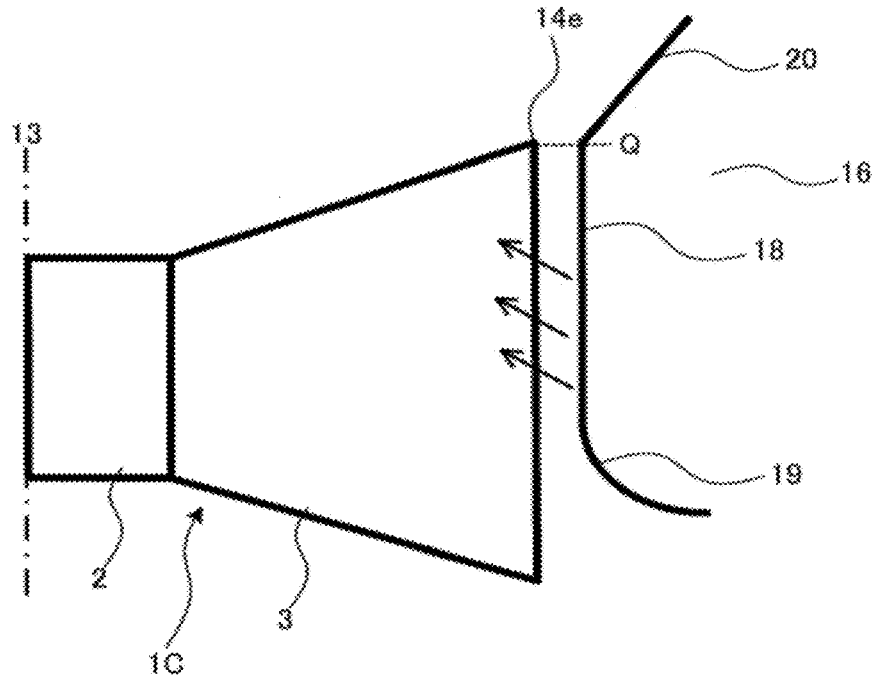
FIG. 13 is an explanatory schematic view for illustrating an operation of an air-sending device according to Embodiment 4 of the present invention.

FIG. 13 is an explanatory schematic view for illustrating an operation of an air-sending device according to Embodiment 4 of the present invention. With reference to FIG. 13, description is made of the air-sending device according to Embodiment 4. FIG. 13 is an illustration of a revolved projection on a cross section including the rotation axis 13 along the radial direction. In Embodiment 4, differences from Embodiments 1 to 3 are mainly described. Components which are the same as those of Embodiments 1 to 3 are denoted by the same reference symbols, and description thereof is omitted.

In a propeller fan 1C of the air-sending device according to Embodiment 4, the downstream end 14*e* of the outer peripheral edge 14 of the blades 3 matches with a downstream end of the duct portion 18. The air stream blowing from the downstream end 14*e* of the blade 3 is high in speed. Thus, when the duct portion 18 extends long toward the downstream, energy loss caused by friction increases. Therefore, in the air-sending device according to Embodiment 4, the downstream end 14*e* of the outer peripheral edge 14 and the downstream end of the duct portion 18 match with each other, thereby being capable of reducing the friction loss and of maintaining the effect similar to that attained with the air-sending device according to Embodiment 3.

Embodiment 5

Figure 14:
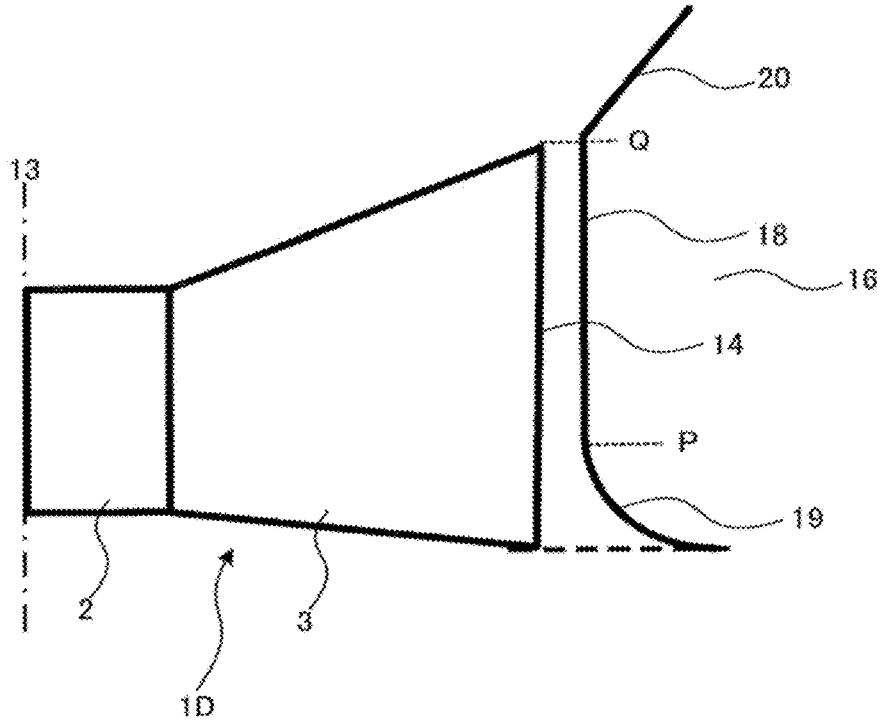
FIG. 14 is an explanatory schematic view for illustrating an operation of an air-sending device according to Embodiment 5 of the present invention.

FIG. 14 is an explanatory schematic view for illustrating an operation of an air-sending device according to Embodiment 5 of the present invention. With reference to FIG. 14, description is made of the air-sending device according to Embodiment 5. FIG. 14 is an illustration of a revolved projection on a cross section including the rotation axis 13 along the radial direction. In Embodiment 5, differences from Embodiments 1 to 4 are mainly described. Components which are the same as those of Embodiments 1 to 4 are denoted by the same reference symbols, and description thereof is omitted.

In a propeller fan 1D of the air-sending device according to Embodiment 5, a part of the outer peripheral edge 14 of the blades 3 is surrounded by the duct portion 18 of the bellmouth 16, and a remainder is surrounded by the entry portion 19. With the air-sending device according to Embodiment 5, when the blades are entirely surrounded by the bellmouth 16 to maintain the pressure increased by the blades 3, the leakage of air caused by a pressure difference can be reduced, thereby being capable of reducing loss. Meanwhile, the blades 3 can suck up the air also from the lateral side. Thus, when a part on the suction side is covered with the entry portion 19 reduced in diameter in the axial direction, the airflow rate of suction from the lateral side can be increased. With the effects described above, the air-sending device according to Embodiment 5 is capable of reducing the loss caused by the flow leakage and of securing a high airflow rate.

Embodiment 6

Figure 15:
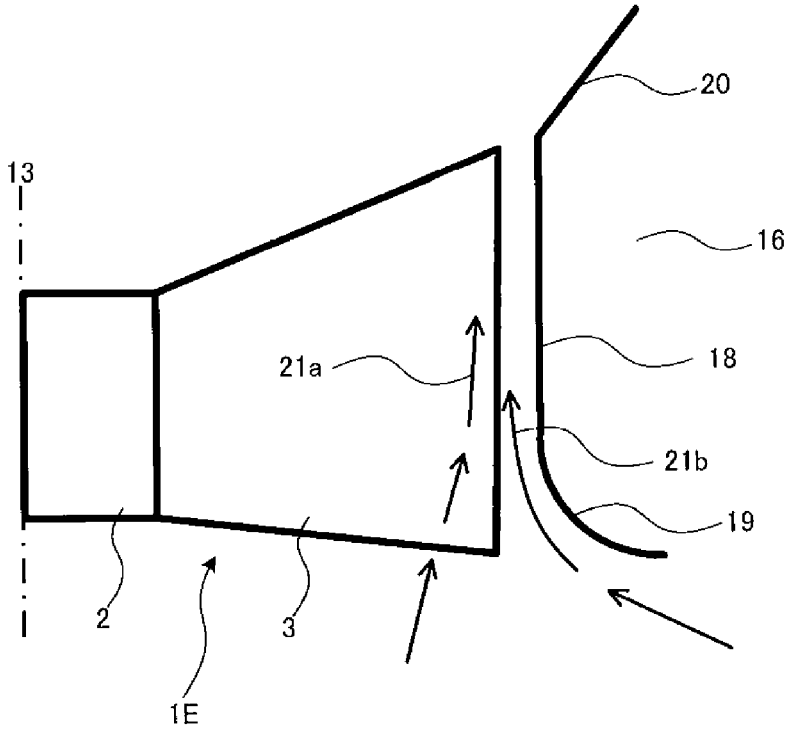
FIG. 15 is an explanatory schematic view for illustrating an operation of an air-sending device according to Embodiment 6 of the present invention.

FIG. 15 is an explanatory schematic view for illustrating an operation of an air-sending device according to Embodiment 6 of the present invention. With reference to FIG. 15, description is made of the air-sending device according to Embodiment 6. FIG. 15 is an illustration of a revolved projection on a cross section including the rotation axis 13 along the radial direction. In Embodiment 6, differences from Embodiments 1 to 5 are mainly described. Components which are the same as those of Embodiments 1 to 5 are denoted by the same reference symbols, and description thereof is omitted.

In a propeller fan 1E of the air-sending device according to Embodiment 6, the entry portion 19 of the bellmouth 16 surrounds the entirety of the outer peripheral edge 14. The entry portion 19 has a curved sectional shape, and a sectional area of the entry portion 19 of the bellmouth 16 is gradually reduced from upstream toward downstream. In the air-sending device according to Embodiment 6, a force directed radially outward acts on the air stream 21*a* passing through the blades near the entry portion 19 of the bellmouth 16. However, the force gradually changes to the force directed radially inward toward the downstream, and the air stream direction is changed from the radially outward direction to the axial direction.

Meanwhile, with the mode in which the sectional area of the entry portion 19 of the bellmouth 16 is gradually reduced from the upstream toward the downstream, the air stream 21*b* which flows in from the lateral side toward the blade 3 changes its direction from the radially inward direction to the axial direction, and matches with the air stream direction of the air having passed through the blades near the duct portion 18. Therefore, with the air-sending device according to Embodiment 6, turbulence which may occur at the time when both the flows merge during inflow from the lateral side to the blades can be reduced. In the example illustrated in FIG. 15, illustration is given of the case in which the entry portion 19 has an arc-shaped cross section. However, the shape of the entry portion 19 is not limited to such a shape, and the same effect can be attained as long as the cross section has a sectional area which is reduced toward the downstream.

Embodiment 7

Figure 16:
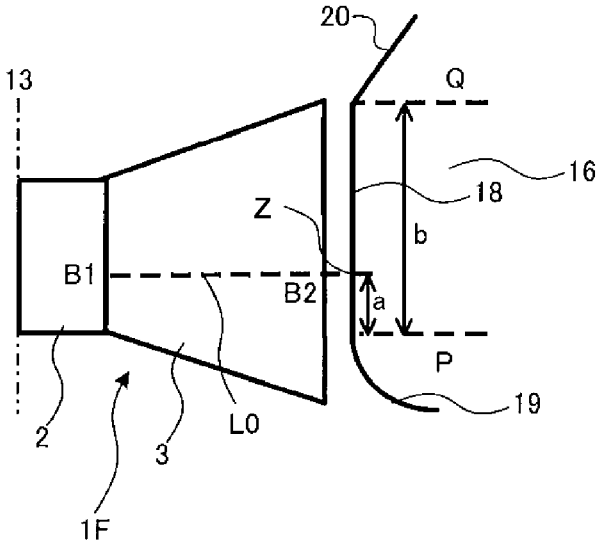
FIG. 16 is an explanatory schematic view for illustrating an air-sending device according to Embodiment 7 of the present invention.
Figure 17:
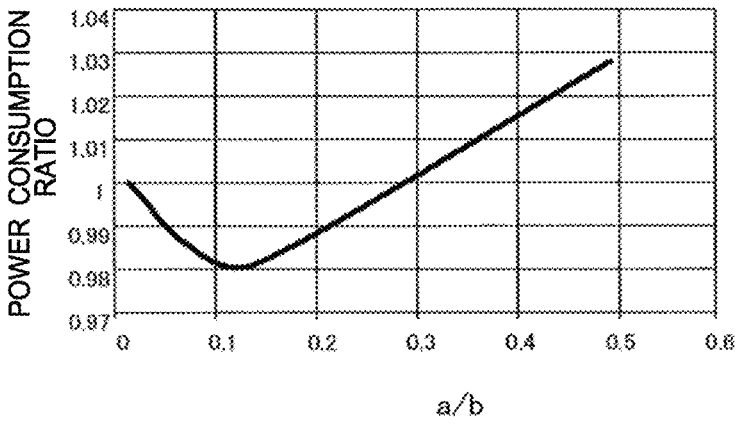
FIG. 17 is an explanatory schematic view for illustrating the air-sending device according to Embodiment 7 of the present invention.
Figure 18:
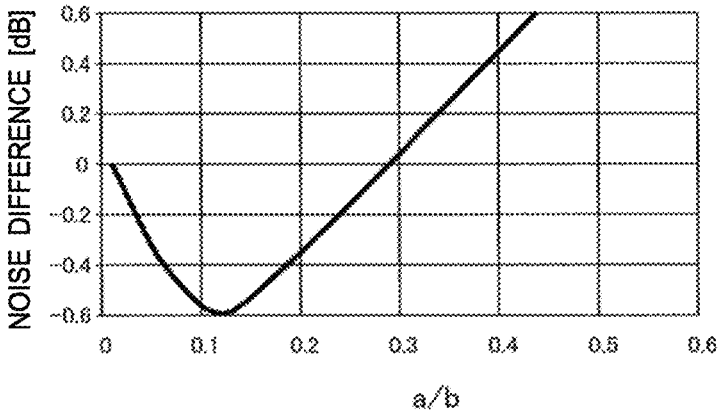
FIG. 18 is an explanatory schematic view for illustrating the air-sending device according to Embodiment 7 of the present invention.

FIG. 16 to FIG. 18 are explanatory schematic views for illustrating an air-sending device according to Embodiment 7 of the present invention. FIG. 17 is a graph for showing a relationship between a position at which the angle θ formed by the straight line L0, which connects a point internally dividing the outer peripheral edge 14 and a point internally dividing the inner peripheral edge 15 at the same ratio as the outer peripheral edge 14 to each other, and the straight line M perpendicular to the rotation axis is 0 degrees and power consumption in the air-sending device according to Embodiment 7. FIG. 18 is a graph for showing a relationship between a position at which the angle θ formed by the straight line L0, which connects a point internally dividing the outer peripheral edge 14 and a point internally dividing the inner peripheral edge 15 at the same ratio as the outer peripheral edge 14 to each other, and the straight line M perpendicular to the rotation axis is 0 degrees and noise in the air-sending device according to Embodiment 7. With reference to FIG. 16 to FIG. 18, description is made of the air-sending device according to Embodiment 7. In Embodiment 7, differences from Embodiments 1 to 6 are mainly described. Components which are the same as those of Embodiments 1 to 6 are denoted by the same reference symbols, and description thereof is omitted.

A line, which connects the point B1 internally dividing the outer peripheral edge 14 of the blades 3 into the upstream side and the downstream side and the point B2 internally dividing the inner peripheral edge 15 into the upstream side and the downstream side at the same ratio as the outer peripheral edge 14 to each other and forms an angle of 0 degrees with the straight line M perpendicular to the rotation axis 13, is defined as L0. An intersection between the line L0 and the duct portion 18 is defined as Z. An axial distance between an upstream end of the duct portion 18 and the intersection Z is defined as "a". Moreover, an axial distance of the duct portion 18 is defined as "b".

FIG. 17 is a graph for showing results of studies, which are conducted through air stream analysis and tests, on power consumption of the air-sending device with respect to a/b. From the results shown in FIG. 17, it can be seen that the effect is exerted when a/b is equal to or larger than 0 and equal to or smaller than 0.3. In particular, a higher effect is exerted when a/b is equal to or larger than 0.05 and equal to or smaller than 0.2, and the feature in that a peak is given around a/b=0.15 is found.

It is conceivable that the feature is improved with a/b in a range of from 0 to 0.15 because the speed difference between the flow from the radially outer side into the blades 3 as illustrated in FIG. 7 and the flow of suction from the duct portion 18 into the blades 3 is gradually eliminated and the loss caused by the vortex is reduced.

When a/b is equal to or larger than 0.3, the region in which the normal direction of the blade surface is oriented outward overlaps with the duct portion 18. Thus, it is conceivable that the air stream hits against the bellmouth 16 to generate the turbulence and causes larger loss, with the result that the feature is degraded.

This similarly applies to the noise difference shown in FIG. 18.

Therefore, the value range of a/b is specified for the propeller fan 1F of the air-sending device according to Embodiment 7. The value range of a/b is specified for the air-sending device according to Embodiment 7, and hence it is highly effective for both the power consumption and noise.

Embodiment 8

Figure 19:
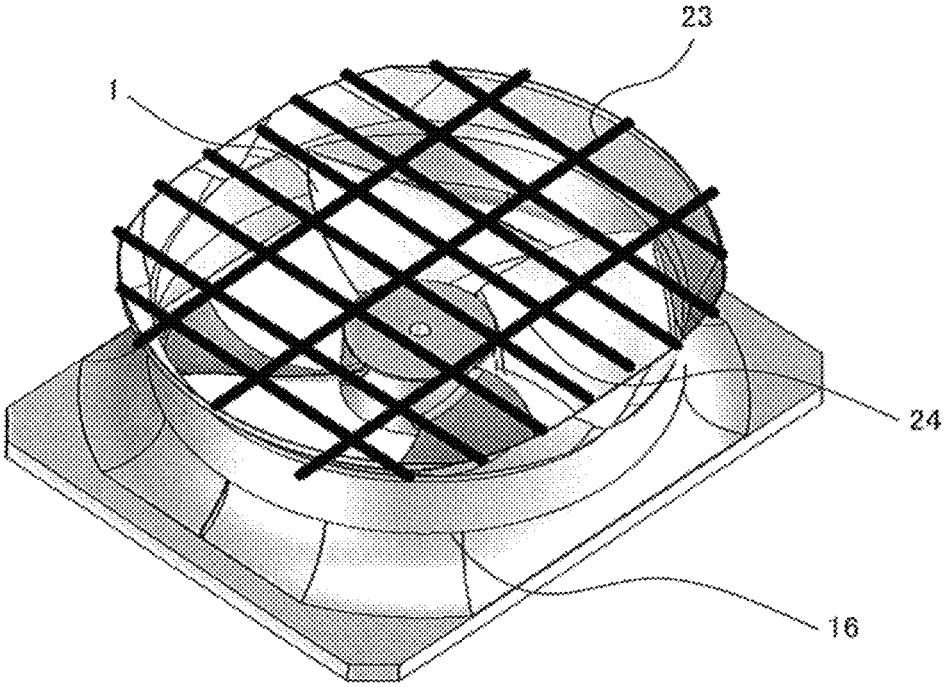
FIG. 19 is a perspective view for illustrating a configuration example of an air-sending device according to Embodiment 8 of the present invention.

FIG. 19 is an a perspective view for illustrating a configuration example of an air-sending device according to Embodiment 8 of the present invention. With reference to FIG. 19, description is made of the air-sending device according to Embodiment 8. In Embodiment 8, differences from Embodiments 1 to 7 are mainly described. Components which are the same as those of Embodiments 1 to 7 are denoted by the same reference symbols, and description thereof is omitted. Here, description is made of an example case in which the propeller fan 1 of the air-sending device according to Embodiment 1 is applied. However, any one of the propeller fans of the air-sending devices according to Embodiments 2 to 7 can be applied.

As illustrated in FIG. 19, in the air-sending device according to Embodiment 8, a protection guard 23 is mounted to a downstream end of the exit portion 20 of the bellmouth 16. The protection guard 23 includes a plurality of bars 24 oriented in lengthwise and widthwise direction and arranged in a lattice form. That is, the air-sending device according to Embodiment 8 includes the protection guard 23 having a mesh shape at the exit portion 20 of the bellmouth 16. The protection guard 23 is mounted for preventing contact of the rotating blades 3 with a finger of a person or a foreign object.

When the air stream blowing from the propeller fan is deflected, the air velocity increases, with the result that loss or turbulence of the air stream increases at the time of passing through the bars 24. In view of such circumstance, the protection guard 23 is provided to the air-sending device according to Embodiment 8, to thereby equalize the blowing air velocity. With such a configuration, the blowing air velocity is equalized so that the air velocity of air stream passing through the bars 24 can be reduced as compared to the related art, thereby being capable of reducing loss and noise.

Embodiment 9

Figure 20:
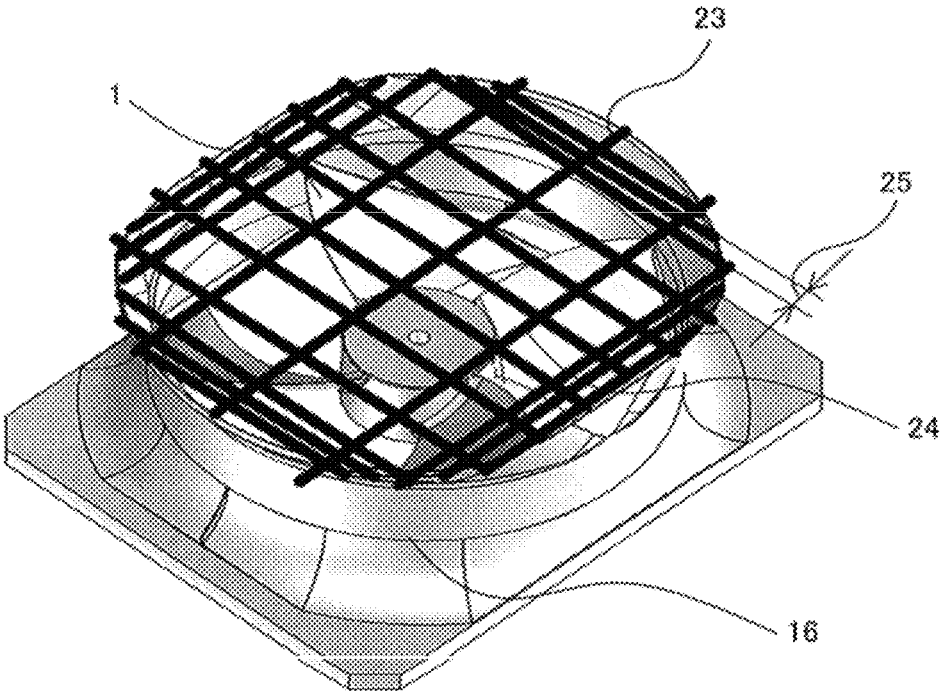
FIG. 20 is a perspective view for illustrating a configuration example of an air-sending device according to Embodiment 9 of the present invention.

FIG. 20 is a perspective view for illustrating a configuration example of an air-sending device according to Embodiment 9 of the present invention. With reference to FIG. 20, description is made of the air-sending device according to Embodiment 9. In Embodiment 9, differences from Embodiments 1 to 8 are mainly described. Components which are the same as those of Embodiments 1 to 8 are denoted by the same reference symbols, and description thereof is omitted. Here, description is made of an example case in which the propeller fan 1 of the air-sending device according to Embodiment 1 is applied. However, any one of the propeller fans of the air-sending devices according to Embodiments 2 to 8 can be applied.

In a case of an air-sending device which is to be installed outdoors, there is a possibility that a strong shock is applied to the protection guard 23 by a flying object or a falling object. Therefore, it is required that the strength be increased by reducing gaps of the bars 24 to prevent breakage of the protection guard 23. A material having high strength may simply be employed, but the material cost is increased. Thus, a simple way is to set the gaps of the bars 24 to be dense in a periphery of the edge of the bellmouth 16, and there are many cases employing such a structure. However, in the related-art air-sending devices, the air stream receives the centrifugal force, and the air flow is deflected toward the outer peripheral portion having smaller gaps of the bars 24, thereby increasing the airflow resistance, with the result that the noise caused by the turbulence generated by the bars 24 is increased.

Therefore, in the air-sending device according to Embodiment 9, a mesh-like protection guard 23 having the bars 24 arranged so that a mesh gap 25 on the radially outer side is set smaller, that is, denser than the mesh gap on the inner side is provided at the exit portion 20 of the bellmouth 16. Therefore, in the air-sending device according to Embodiment 9, the blowing air stream is equalized in the radial direction, and the air velocity of air passing through the bars 24 having small gaps is reduced. As a result, with the air-sending device according to Embodiment 9, power saving and reduction in noise in the device owing to the reduction in airflow resistance at the protection guard 23 can be achieved. In addition, the bars 24 are arranged so that the mesh gaps on the radially outer side are set smaller than those on the inner side, and hence the strength of the protection guard 23 is increased.

Embodiment 10

Figure 21:
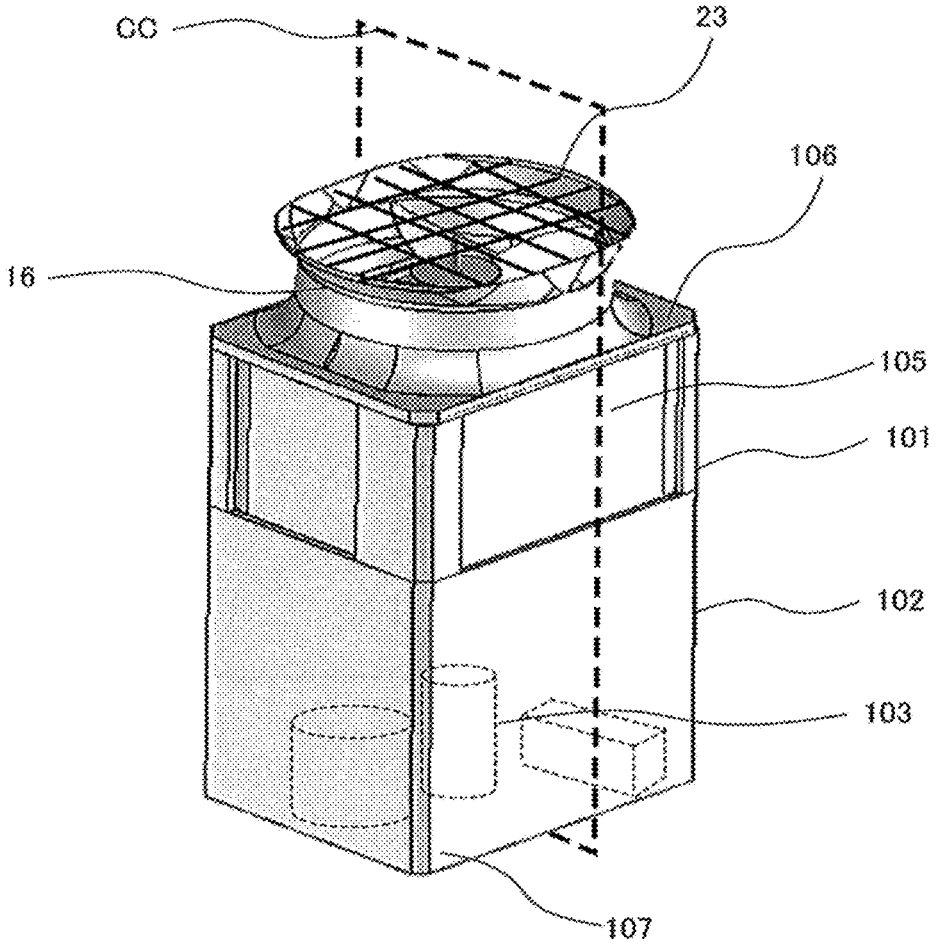
FIG. 21 is a perspective view for illustrating a configuration example of an outdoor unit of an air-conditioning apparatus according to Embodiment 10 of the present invention.
Figure 22:
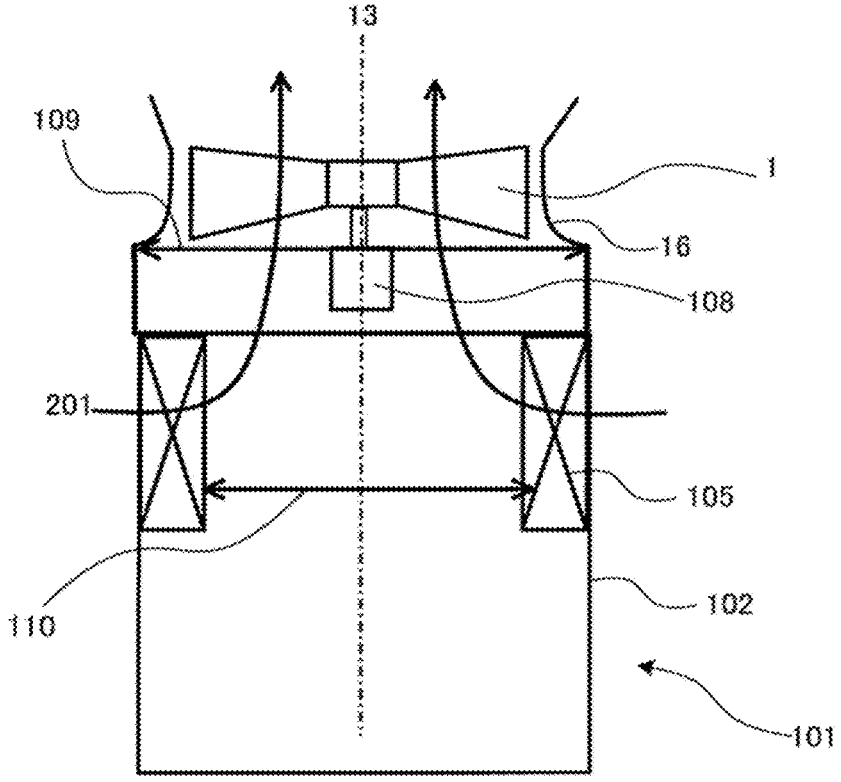
FIG. 22 is a schematic view for illustrating the outdoor unit of Embodiment 10 of the present invention, and is an illustration of a cross section of the outdoor unit taken along the plane CC including a rotation axis of a propeller fan.

FIG. 21 is a perspective view for illustrating a configuration example of an outdoor unit 101 of an air-conditioning apparatus according to Embodiment 10 of the present invention. FIG. 22 is a schematic view for illustrating a cross section of the outdoor unit 101 taken along the plane CC including the rotation axis 13 of the propeller fan 1. With reference to FIG. 21 and FIG. 22, description is made of the air-conditioning apparatus according to Embodiment 10. In Embodiment 10, differences from Embodiments 1 to 9 are mainly described. Components which are the same as those of Embodiments 1 to 9 are denoted by the same reference symbols, and description thereof is omitted. Here, description is made of an example case in which the air-sending device according to Embodiment 1 is applied to the outdoor unit 101. However, any one of the propeller fans of the air-sending devices according to Embodiments 2 to 9 can be applied to the outdoor unit 101.

The air-conditioning apparatus forms a refrigeration cycle by connecting an indoor unit (not shown) and the outdoor unit 101 like the one illustrated in FIG. 21 to each other by refrigerant pipes and allowing refrigerant to circulate between the units. The outdoor unit 101 includes a casing 102 and in-unit devices 103 accommodated in the casing 102. The indoor unit includes a casing and in-unit devices accommodated in the casing. The in-unit devices 103 may include, for example, a compressor, a pressure reducing device, and an accumulator. Moreover, the in-unit devices of the indoor unit may include, for example, a heat exchanger and an air-sending device.

A heat exchanger 105 configured to exchange heat between refrigerant and air is mounted to the casing 102. The heat exchanger 105 is arranged so as to be opposed to side surfaces of the casing 102. An upper end of the casing 102 is covered with a top plate 106, and a bottom plate 107 is mounted to a lower end of the casing 102. The bellmouth 16 surrounding the air outlet is mounted to the top plate 106. The protection guard 23 is provided at the downstream end of the bellmouth 16. Moreover, a fan motor 108 configured to drive the propeller fan 1 is provided on a lower side of the propeller fan.

It is preferred that an installation area of the outdoor unit 101 be set as small as possible to enhance the degree of freedom in installation location. Meanwhile, it is preferred that a diameter of the propeller fan be set as large as possible to reduce the air-blowing sound, and there is a case in which a unit width is substantially equal to a diameter of the propeller fan. In the outdoor unit 101, an inner width 110 of the heat exchanger 105 is set smaller than a width 109 of the bellmouth at a most upstream part. Therefore, in the outdoor unit 101, when the air stream 201 having passed through the heat exchanger 105 flows to the air-sending device, the air stream 201 flows toward the rotation axis side, and the air flows toward the inner peripheral side of the air-sending device.

The air-sending device according to any one of Embodiments 1 to 9 is applied to the outdoor unit 101. Therefore, the air stream can be distributed to the outer side, thereby being capable of operating the air-sending device in a highly efficient state.

The air-conditioning apparatus can be applied to, for example, a room air-conditioning apparatus, a package air-conditioning apparatus, a multi-type air-conditioning apparatus for buildings, a heat pump water heater, or a refrigeration device such as a showcase. Moreover, when a flow switching device (for example, a four-way valve, or a combination of two-way valves or three-way valves) is provided on a discharge side of a compressor, a heating operation and a cooling operation can be switched.

REFERENCE SIGNS LIST

1 propeller fan 1A propeller fan 1B propeller fan 1C propeller fan 1D propeller fan 1E propeller fan 1F propeller fan 2 boss 3 blade 5 rotation direction 6 leading edge 7 trailing edge 8 outer peripheral end 9 inner peripheral end 10 air stream direction 11 pressure surface 12 suction surface 13 rotation axis 14 outer peripheral edge 14*e* downstream end

15 inner peripheral edge 16 bellmouth 18 duct portion 19 entry portion 20 exit portion 21 air 21*a* air stream 21*b* air stream 22 vortex 23 protection guard 24 bar 25 mesh gap 100 propeller fan 101 outdoor unit 102 casing 103 in-unit device 105 heat exchanger 106 top plate 107 bottom plate 108 fan motor 109 width 110 width 130 rotation axis 160 bellmouth 180 duct portion 190 entry portion 200 boss 201 air stream 300 blade

The invention claimed is:

1. An air-sending device, comprising:

a propeller fan including a boss mounted to a rotation axis and a plurality of blades mounted on a periphery of the boss; and a bellmouth surrounding an outer peripheral edge of the propeller fan, wherein the bellmouth includes:

a duct portion having a cylindrical shape and surrounding the outer peripheral edge of the propeller fan; and an entry portion, which is formed on upstream of the duct portion, and is reduced in air passage area from upstream toward downstream, wherein, in the blades, an upstream end of a blade outer periphery is more on an upstream side than an upstream end of a blade inner periphery, and a downstream end of the blade outer periphery is more on a downstream side than a downstream end of the blade inner periphery, as seen along the rotation axis, wherein the blade inner periphery and the blade outer periphery are inclined with respect to a rotation direction of the blades such that, when the blades rotate, the blade inner periphery approaches the downstream end of the blade inner periphery from the upstream end of the blade inner periphery and the blade outer periphery approaches the downstream end of the blade outer periphery from the upstream end of the blade outer periphery, wherein, in the blades, when an angle formed by a line segment, which connects a point internally dividing a line segment connecting the downstream end and the upstream end of an outer periphery of the blades along the rotation axis and a point internally dividing a line segment connecting the downstream end and the upstream end of an inner periphery of the blades along the rotation axis at the same ratio to each other, and a reference line being a straight line perpendicular to the rotation axis is defined as $\theta$, and a direction inclined toward the downstream side is defined as positive, the angle $\theta$ falls in the range between negative values and positive values at the duct portion, wherein an angle formed by a line segment, which connects a point bisecting the line segment connecting the downstream end and the upstream end of the outer periphery of the blades along the rotation axis and a point bisecting the line segment connecting the downstream end and the upstream end of the inner periphery of the blades along the rotation axis to each other, and the reference line is a positive value, and when a line, which connects a point internally dividing the outer peripheral edge of the blades into an upstream side and a downstream side and a point internally dividing the inner peripheral edge of the blades into the upstream side and the downstream side at the same ratio as the outer peripheral edge to each other and forms an angle of 0 degrees with the reference line, is defined as L0, an intersection between the line L0 and the duct portion is defined as R, an axial distance between an upstream end of the duct portion and the intersection R is defined as "a", and an axial distance of the duct portion is defined as "b", a/b is set within a range of equal to or larger than 0 and equal to or smaller than 0.3.

2. The air-sending device according to claim 1, wherein the downstream end of the outer peripheral edge of the blades is surrounded by the duct portion.

3. The air-sending device according to claim 2, wherein the downstream end of the outer peripheral edge of the blades and a downstream end of the duct portion extend a same distance in a downstream side direction as seen along the rotation axis.

4. The air-sending device according to claim 1, wherein the downstream side of the outer peripheral edge of the blades is surrounded by the duct portion, and the upstream side of the outer peripheral edge of the blades is surrounded by the entry portion.

5. The air-sending device according to claim 1, wherein, in a cross section obtained by a revolved projection on a plane including the rotation axis, the entry portion has a curved shape.

6. The air-sending device according to claim 1, wherein the a/b is set within a range of equal to or larger than 0.05 and equal to or smaller than 0.2.

7. The air-sending device according to claim 1, further comprising a protection guard having a mesh-like shape at an exit portion of the bellmouth, wherein gaps of the mesh of the protection guard on the radially outer side are smaller than gaps on the inner side.

8. An air-conditioning apparatus, comprising the air-sending device of any one of claim 1 in an outdoor unit.

9. The air-sending device according to claim 1, wherein, in a region of the blades in which the θ is positive value, a normal line to a downstream surface of each of the blades is oriented radially inward in a cross section of each of the blades along a line which internally divides between the upstream end of each of the blades and the downstream end of each of the blades at the same ratio in a radial direction of the blades.

10. The air-sending device according to claim 9, at least in the region outward of a center line between the blade inner periphery and the blade outer periphery, the normal line to the downstream surface in the cross section is oriented radially inward.

11. The air-sending device according to claim 9, the cross section is curved such that, in the cross section, a center line between the blade inner periphery and the blade outer periphery is positioned in an upstream side of a line segment connected between the blade inner periphery and the blade outer periphery.

12. The air-sending device according to claim 1, wherein the boss is cylindrically shaped.

* * * * *